US009004232B2

(12) United States Patent
Attinger

(10) Patent No.: US 9,004,232 B2
(45) Date of Patent: Apr. 14, 2015

(54) SUSPENSION-MEANS END-FASTENER WITH FIXING ELEMENT

(75) Inventor: Adrian Attinger, Merlischachen (CH)

(73) Assignee: Inventio AG, Hergiswil (CH)

( * ) Notice: Subject to any disclaimer, the term of this patent is extended or adjusted under 35 U.S.C. 154(b) by 623 days.

(21) Appl. No.: 12/902,690

(22) Filed: Oct. 12, 2010

(65) Prior Publication Data

US 2011/0139551 A1 Jun. 16, 2011

(30) Foreign Application Priority Data

Dec. 10, 2009 (EP) ..... 09178674

(51) Int. Cl.
*B66B 7/08* (2006.01)

(52) U.S. Cl.
CPC ..... *B66B 7/085* (2013.01)

(58) Field of Classification Search
CPC ..... B66B 7/08; B66B 7/085
USPC ..... 187/411; 403/375; 24/136 K, 136 L, 24/115 H, 197
IPC ..... B66B 7/08
See application file for complete search history.

(56) References Cited

U.S. PATENT DOCUMENTS 4,365,391 A * 12/1982 Chapalain ..... 24/197
4,493,135 A * 1/1985 Crook, Jr. ..... 24/197
6,484,368 B1 * 11/2002 Rivera et al. ..... 24/115 R
7,647,675 B2 * 1/2010 Ach ..... 24/129 R
8,181,312 B2 * 5/2012 Attinger et al. ..... 24/136 R
2007/0051564 A1 * 3/2007 Ach ..... 187/411
2009/0307876 A1 * 12/2009 Pitts et al. ..... 24/136 R

FOREIGN PATENT DOCUMENTS

DE 1937155 A1 2/1971
EP 2000431 A1 12/2008
EP 2261162 * 12/2010

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An end-fastener for fastening a suspension device of an elevator system has a housing which contains two side walls. The end-fastener has at least two essentially cylindrical wrap-round elements for fastening the suspension device, wherein the wrap-round elements each extend between the two side walls. The second wrap-round element is embodied as a movable bolt which can be inserted into the housing. The end-fastener includes a fixing element which can be mounted on the housing for fixing the second wrap-round element in its position in the housing. The fixing element is embodied in such manner that it engages in at least one groove of the second wrap-round element that comes to lie between the side walls of the housing.

11 Claims, 3 Drawing Sheets

SUSPENSION-MEANS END-FASTENER WITH FIXING ELEMENT

FIELD OF THE INVENTION

The invention relates to a suspension-means end-fastener for the purpose of fastening a suspension means of an elevator system, and an elevator system in which the suspension means is fastened via a suspension-means end-fastener.

BACKGROUND OF THE INVENTION

The suspension means for an elevator car must be fastened securely in the elevator hoistway so as to transmit the forces that occur onto a supporting structure which is arranged in the elevator hoistway. The suspension means, for example ropes or belts, are fastened by their end-pieces into the suspension-means end-fastener during installation. Normally for this purpose, a loop is laid in the rope or belt, and the suspension means is jammed in the suspension-means end-fastener, for example by a wedge, which exerts on the rope or belt a press-on pressure so that the latter is pressed against the housing of the suspension-means end-fastener and cannot work loose.

Alternatively known is to lay a loop of a suspension-means end-piece around two wrap-round elements in such manner that, between the oppositely running sections of the loop, a coefficient of friction prevails which is of such magnitude that the suspension means jams itself between the two wrap-round elements. Here too, in addition to the wrapping, also a press-on pressure of a housing part can be exerted on the suspension means.

A suspension-means end-fastener in which the suspension means is wrapped around two wrap-round elements is known, for example, from WO 2008/148768. Here, a wrap-round element is fixed in the housing, and the second wrap-round element can be inserted into the loop through an opening in the housing. Here, the second wrap-round element consists of a sleeve and a bolt for insertion into the sleeve, the bolt being fixed in the sleeve by means of a mechanism which is tensioned by a spring.

SUMMARY OF THE INVENTION

An object of the present invention is to propose a suspension-means end-fastener in which fixing of the second wrap-round element is improved.

Accordingly, one aspect involves a suspension-means end-fastener for fastening a suspension means of an elevator system. The end-fastener has a housing having two side walls, and at least two essentially cylindrical wrap-round elements configured to fasten the suspension means. The respective wrap-round elements each extend between the two side walls, wherein the second wrap-round element is embodied as a movable bolt configured to be inserted into the housing at a predetermined position, wherein the second wrap-round element has at least one groove, and wherein the groove is located between the side walls of the housing when the second wrap-round element is in its position. The end-fastener includes further a fixing element configured to be mounted on the housing for fixing the second wrap-round element in its position in the housing, wherein the fixing element is configured to engage in the at least one groove of the second wrap-round element.

The invention is based on the knowledge that the fixation of a bolt that is inserted into the housing, and which forms the second wrap-round element, can take place particularly simply if this bolt has a groove into which a fixing element that can be mounted on the housing engages. The bolt can then no longer be pushed against the fixing element or hence also against the housing. The bolt is thereby fixed in its position in the housing. The groove can run in the lengthwise or in the crosswise direction of the bolt. Advantageously, the fixing element remains stable in its position in relation to the housing.

This is particularly achieved through the fixing element being embodied in such manner that it can be tightly fastened to the housing, particularly to a lower yoke of the housing. Every force that arises through pushing the bolt against the fixing element can thereby be transferred to the housing. Through its being fastened to the housing, the fixing element is secured against forces transmitted by the bolt, and can thus secure the position of the bolt in the housing.

A further advantageous embodiment of the invention is characterized in that the fixing element has a surface that extends essentially parallel to a side wall of the housing into the housing, the surface having a recess which is complementary to the cross-sectional form of the second wrap-round element, and the recess being dimensioned in such manner that it can accept the second wrap-round element only at its at-least one groove. This has the advantage that the groove of the bolt need not take the form of a point, but can extend over a relatively long distance. The recess, and the groove of the bolt or wrap-round element that corresponds to it, thus have a relatively large area over which they engage into each other. A relatively high security of the fixing of the bolt is hereby attained, since the probability that the fixing element slips out of the groove of the bolt is minimized.

Moreover, it is advantageous that the bolt can be accepted by the fixing element only at the point with its groove, so that during installation it is assured that the fixing element or bolt sits optimally relative to the position of the fixing element. If the fixing element is fastened on the housing in such manner that the surface with its recess does not engage directly in the groove of the bolt, the bolt cannot be accepted in the recess, and the fixing element with its surface cannot penetrate deeply enough into the housing, so that it is immediately apparent to an installation technician that the fixing element cannot be correctly positioned. Only when the recess accepts the bolt into itself is the fixing element correctly mounted on the housing and does not project beyond the side walls of the housing.

A further advantageous embodiment of the invention is characterized in that the surface of the fixing element that extends into the housing is dimensioned in such manner that the flanks of the recess extend beyond the mid-point of the cross section of the second wrap-round element. This ensures that even if the fixing element is not quite optimally mounted on the housing, the flanks still engage in the groove on the bolt and thereby protect the latter against lateral displacement. Also in this case, the bolt cannot slide out of the housing, which would cause the eye of the suspension means that is wrapped around the former to be no longer secured, and the suspension means would work loose out of the suspension-means end-fastener.

A further advantageous embodiment of the invention is characterized in that the flank of the fixing element that is arranged between the lower yoke of the housing and the second wrap-round element is dimensioned in such manner that it essentially fills the space between the yoke and the wrap-round element. This has the advantage that even when the fixing element is released, and the surface with the groove no longer accepts the bolt completely into itself, because it is pulled diagonally away from the bolt, the flank of the fixing element still engages in the groove. Release of the fixing element and pulling away or lifting away diagonally downwards, still does not cause the bolt to be able to execute a sideways movement. Hence the bolt is also secured when the fixing element has slackened a little and is no longer 100 percent tightly fastened to the housing. Only when the fixing element is completely separated from the housing, for example by an installation technician who has unscrewed it, is the bolt free and its removal from the housing possible.

A further advantageous embodiment of the invention is characterized in that a suspension-means end-piece that is laid into a loop can be arranged in the housing in such manner that the two oppositely-running sections of the loop wrap round the first wrap-round element, and that the second wrap-round element can be inserted through the eye of the loop. For the installation technician on site this is particularly advantageous, since he must only lay a simple loop in the suspension means. The loop is led into the housing and around the first wrap-round element and then automatically forms an eye, into which in simple manner the bolt, or second wrap-round element, can be inserted. In conjunction with the fixing element, which can then be laid or passed over the bolt and subsequently fastened, a particularly simple installation of the suspension-means end-fastener, or of the suspension means in the suspension-means end-fastener, and a simple fixing of the suspension means in the suspension-means end-fastener, is thus possible.

DESCRIPTION OF THE DRAWINGS

The novel features characteristic of the invention are set out in the claims below. The invention itself, however, as well as other features and advantages thereof, are best understood by reference to the detailed description, which follows, when read in conjunction with the accompanying drawings, wherein:

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
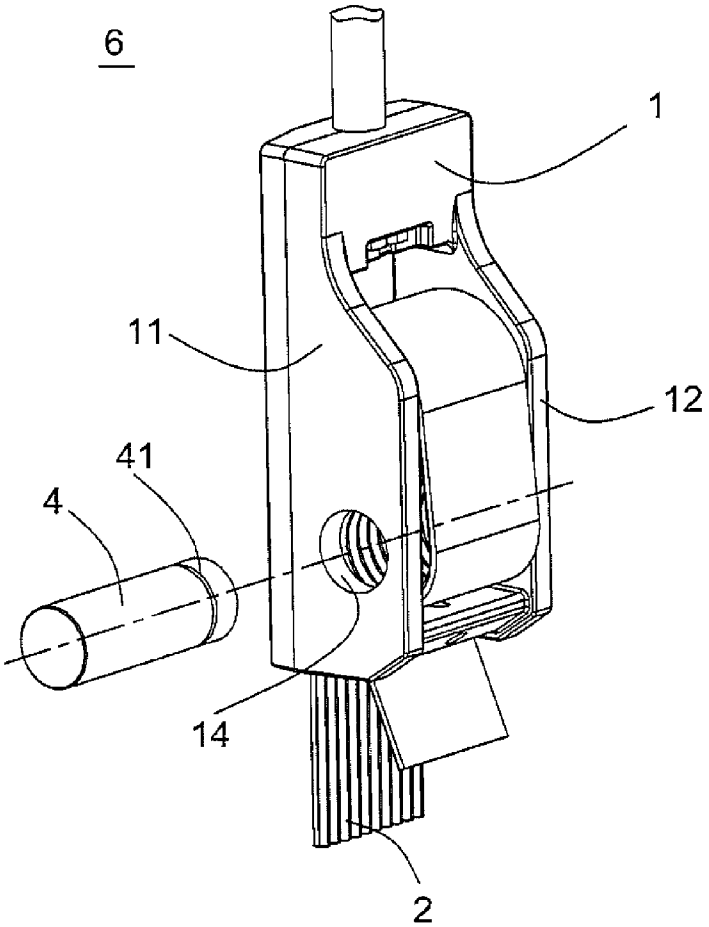
FIG. 1 shows a suspension-means end-fastener with suspension means into which a second wrap-round element is inserted according to the invention.
Figure 4:
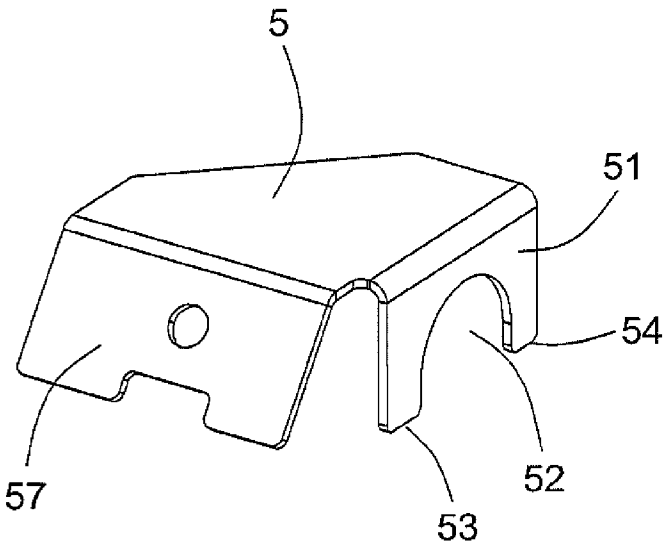
FIG. 4 shows the fixing element of FIG. 2.

FIG. 1 shows a suspension-means end-fastener 6 which is intended to accept a suspension means 2, and in which the suspension means 2 is fastened in such manner that it is held tight by the suspension-means end-fastener 6. The suspension-means end-fastener 6 has a housing 1 which has two side walls 11, 12. On the front side, the housing 1 is essentially open. The suspension means 2 is arranged in the housing 1 in such manner that a movable wrap-round element 4, which is insertable into the housing, comes to lie in the eye of a loop of the suspension means. The wrap-round element 4 has a circumferential groove 41. This groove serves to fix the wrap-round element 4 with a fixing element 5, as shown in FIGS. 2 and 4.

Figure 2:
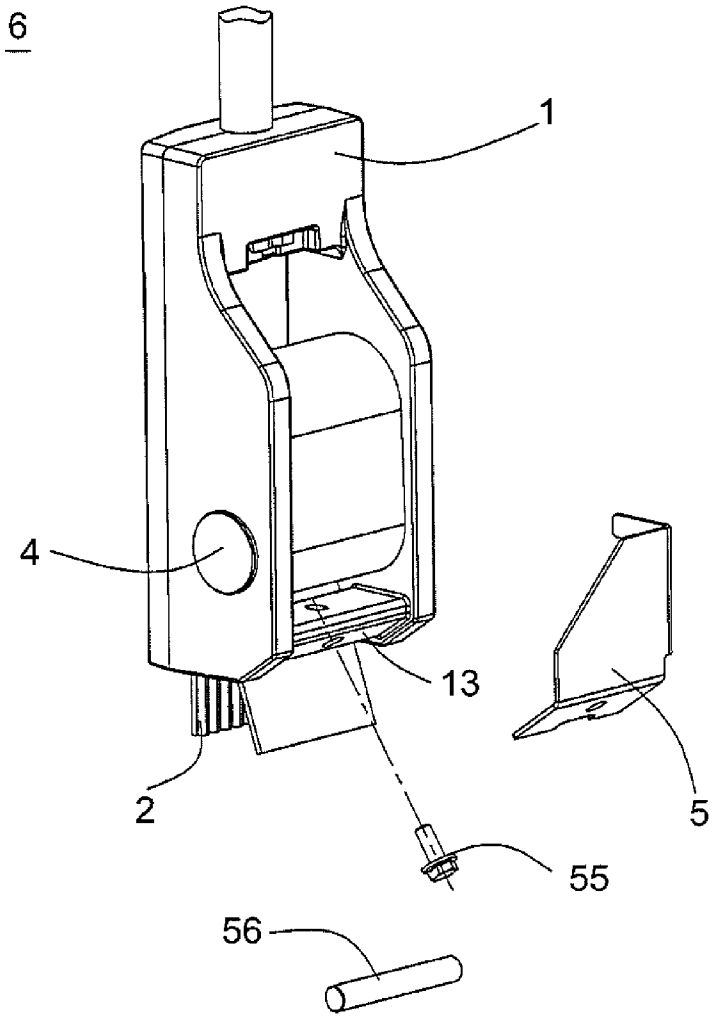
FIG. 2 shows the suspension-means end-fastener of FIG. 1 and a fixing element.

Shown in FIG. 2 is the suspension-means end-fastener 6 in which the wrap-round element 4 is now inserted and wrapped round by an eye of the suspension means 2. The suspension means 2 is now held in the suspension-means end-fastener 6 by the frictional force between the surfaces of the suspension means. The wrap-round element 4 is insertable through an opening 14 through each of the side walls 11, 12 of the housing 1. So that the wrap-round element 4 can now be fixed in its position in the housing 1, and does not slip sideways or slide out of the housing, the fixing element 5 is fastened onto a lower yoke 13 of the housing. The fixing element 5 can also be fastened on other points of the housing 1, for example on the side wall 11 or 12 of the housing. A fastening on the lower yoke 13 is particularly easy to realize, since a surface of the fixing element 5 with a drilled hole can be screwed onto the yoke 13 by means of a screw 55.

Figure 5:
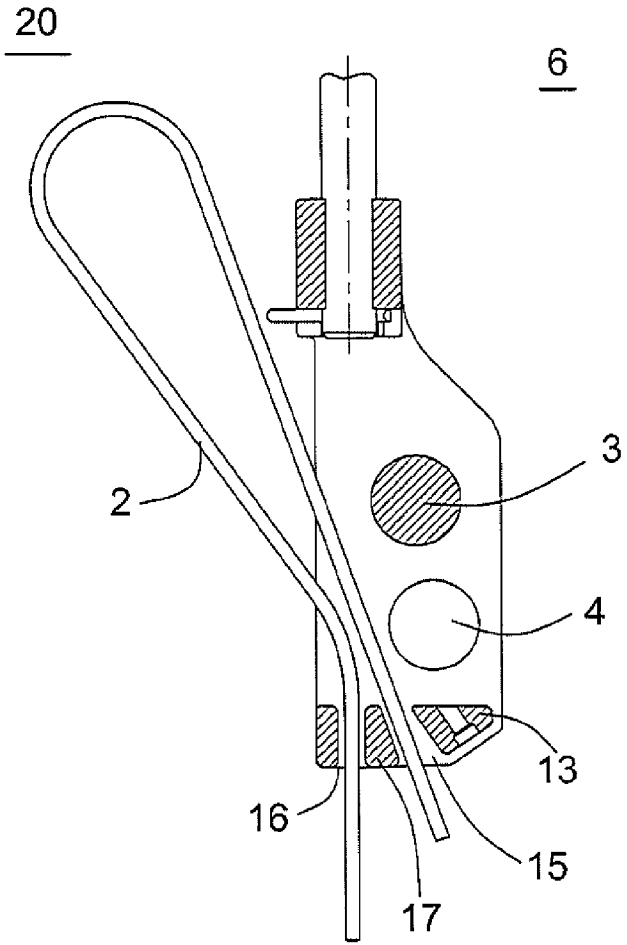

Along with this, a roller or pin-shaped element 56 can also be mounted under the fixing element 5, or between the fixing element and the suspension means 2. The pin-shaped element 56 can be of metal, or of another non-flammable, particularly electrically non-conductive, material. When screwing the fixing element 5 tight, the pin-shaped element 56 is essentially jammed between the fixing element and the suspension means 2, and thus exerts a pressure on the end of the suspension means. This serves to additionally secure the suspension means 2 in the housing 1. Particularly in the case of fire, when an elastomer, which sheathes metallic load-bearing tension-bearers arranged in the suspension means 2, melts away, sufficient pressure is no longer exerted on the tension bearers, and the frictional force of the suspension means is also no longer sufficient to hold the latter in the suspension-means end-fastener 6. In this case the roller 56, which is not flammable, is pulled into a gap 15 between the first yoke 13 and a second yoke 17 (FIG. 5). The tension bearers thus experience a pressure, and are jammed against the housing by the roller or pin 56. This is further reinforced through the gap 15 between the first yoke 13 and the second yoke 17 narrowing in the direction of the inside of the housing 1. When burning occurs, and thus a slipping-out of the suspension means 2 results, the non-flammable metallic or non-metallic tension-bearers pull the roller 56 into the narrowing slit 15, and the roller 56 then ensures a jamming-tight and secure holding of the metallic or non-metallic tension bearers. Overall, this prevents the suspension means 2 from working loose. Particularly advantageous is for the pin or roller 56 to be embodied from electrically non-conductive material. If the condition of the tension bearers is monitored by means of electrical continuity, the occurrence of an electrical connection through the pin-shaped element 56 caused by the roller pressing on the strands must be prevented.

Figure 3:
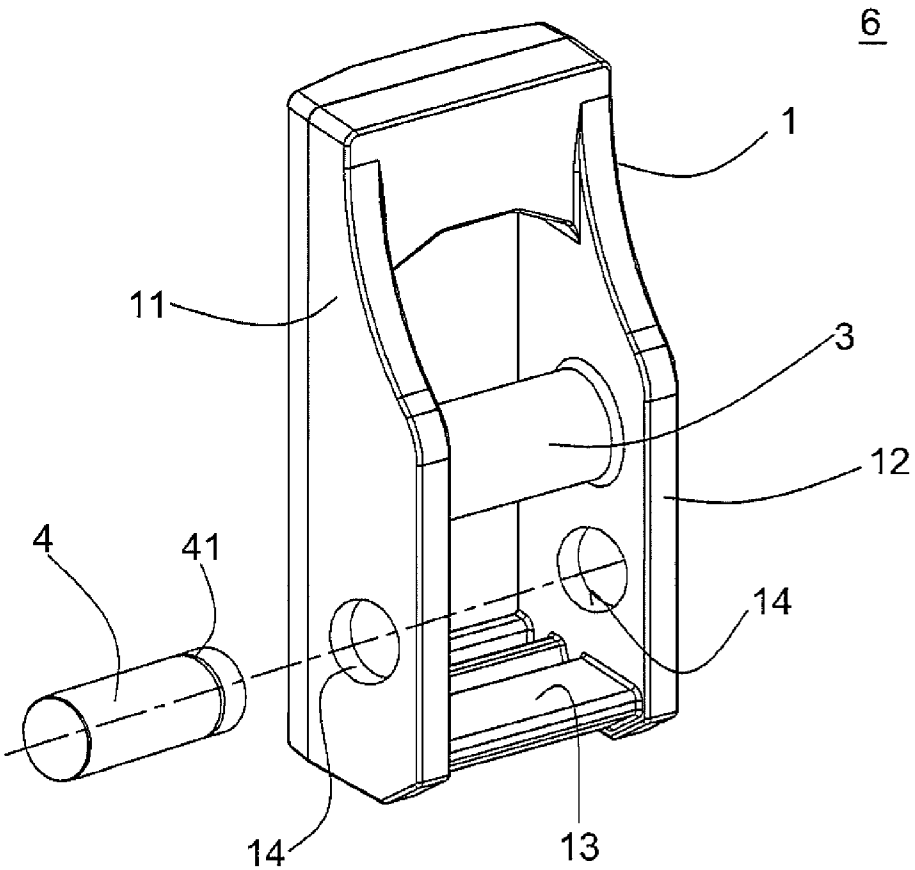
FIG. 3 shows the suspension-means end-fastener of FIG. 1 with the insertable wrap-round element.

FIG. 3 shows the suspension-means end-fastener 6 in a state in which no suspension means is inserted. The suspension-means end-fastener 6 has the housing 1 with the two side walls 11, 12, and a first wrap-round element 3 being mounted between the side walls. The second wrap-round element 4 can be inserted into the housing 1 through the opening 14 in the side wall 11 or 12. This normally takes place after the suspension means 2 has already been looped into the housing, and then the second wrap-round element 4, or bolt, is inserted into the eye of the suspension means. To show how the suspension means 2 should be arranged in the suspension-means end-fastener 6, a sketch of the arrangement is displayed on the side surface 11. If the second wrap-round element 4 is now inserted into the end-fastener 6, the groove 41 of the second wrap-round element comes to lie inside the housing 1, hence between the two side walls 11 and 12. It is advantageous if the groove 41 lies within the housing 1 but relatively near to the edge, thus close to one of the two side walls 11, 12.

FIG. 4 shows the fixing element 5 which serves to fix the second wrap-round element 4 which is shown in FIGS. 1 and 3. A recess 52 of the fixing element engages in the groove 41 of the wrap-round element 4. The fixing element 5 can be fastened onto the housing 1. For this purpose, in the embodiment shown, a flat element 57 is proposed which has a bored hole through which, by means of the screw 55, it can be fastened onto the lower yoke 13 of the housing 1 of the suspension-means end-fastener 6. The fastening onto the housing 1 can, however, also take place in another manner. The fixing element 5 has a surface 51 which, in the installed state, extends parallel to the side wall 11, 12 of the housing 1. The embodiment shown is only one example. The surface 51 can extend on both sides of the housing 1. In this case, the fixing element 5 would have two parallel surfaces which extend along the side surfaces of the housing 1. Each of the two surfaces would then engage in one of two grooves of the bolt 4, or accept the bolt at one of two grooves. In the exemplary embodiment shown, the surface 51 has the recess 52. The recess 52 is provided for the purpose of accepting the wrap-round element 4. The recess 52 is dimensioned in such manner that the wrap-round element 4 can only be accepted into it when the walls of the recess engage in the groove 41 of the wrap-round element.

The two flanks 53, 54 of the recess 52 extend so far down that they project beyond the middle of the wrap-round element 4. This ensures that even if the fixing element 5 does not seat 100 percent, the surface 51 of the fixing element is able to hold the wrap-round element 4 in its position. For improved fixing, the flank 53 is so selected in its width that, on inserting the fixing element 5 into the housing 1, there is just that amount of space for the flank 53 between the yoke 13 and the bolt or wrap-round element 4, which is wrapped by the suspension means 2, that the fixing element can be placed there. A rotational movement of the entire fixing element 5, when, for example, the surface 57 is no longer completely tightly screwed to the yoke 13, can thus not immediately cause a slackening of the bolt 4. In the case that the fixing element 5 slackens a little and becomes unsteady, the flank 53 would nevertheless still be near enough to the bolt 4 and, on rotating, still even engage in the groove 41. Particularly in conjunction with the ring-shaped groove 41 in the bolt 4, it is assured that the flank 53 always engages. Such a ring-shaped groove 41 in the bolt 4, in other words a circumferential groove, has the further advantage that the bolt need only be adjusted in relation to its lateral direction. Turning of the bolt 4 in the housing 1, to bring it into a position in which the fixing element 5 can engage, is not necessary.

To signal to the installation technician that the small roller or pin 56, which also in case of fire can prevent the suspension means 2 from working loose, should be positioned between the fixing element 5 and the suspension means 2, this fact is graphically represented on the fixing element. The special embodiment of the fixing element 5 as shown in FIG. 4 is only one example. The fixing element 5 can be fastenable on any point of the housing 1. Of relevance is that, in the fastened state, the fixing element 5 engages in the groove 41 of the bolt 4, and thereby protects the latter against lateral movement. Also conceivable for this purpose is a fixing on the side walls 11, 12, or a fixing element with a completely different shape, and two surfaces that each run to a side wall of the housing 1 and there penetrate into its depth and hold the wrap-round element in its position. The recess 52 need also not be round as shown, it adapts to the shape of the bolt 4 and, if the bolt has another shape, the recess 52 would have a corresponding complementary form. Self-evidently, the fixing element 5 could also be a simple deeply-projecting element, without recess, which engages in a groove of the bolt 4.

Figure 7:
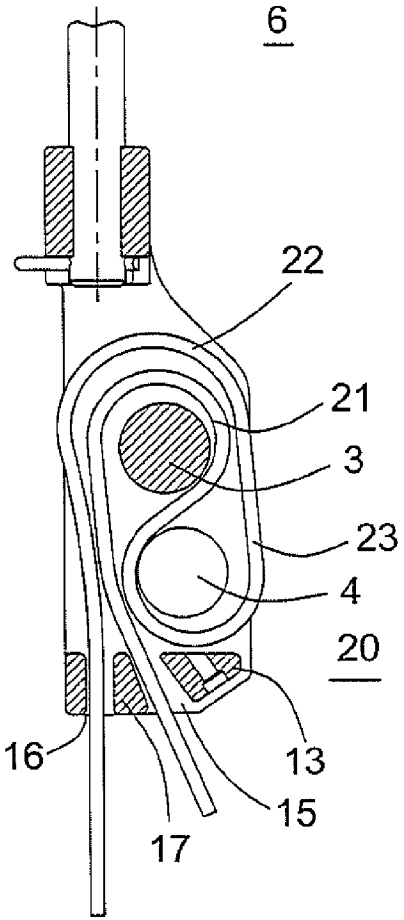
FIGS. 5, 6, 7 are cross-sectional side elevation views showing laying a suspension means into the suspension-means end-fastener.
Figure 6:
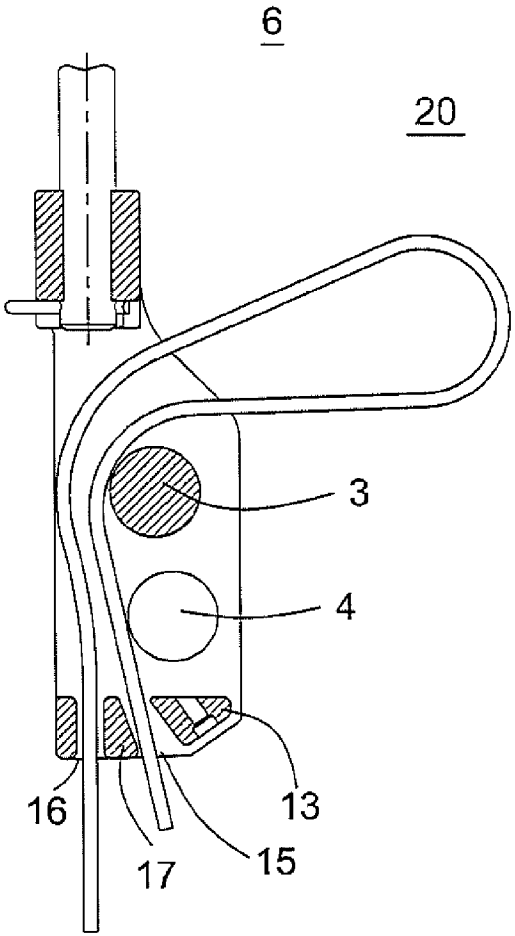

FIGS. 5, 6, and 7 show the laying of the suspension means 2 into the suspension-means end-fastener 6. The suspension means 2 is laid into a loop 20. This takes place by the end of the suspension means 2 being passed by an installation technician through an opening 16 that is provided in the housing 1. The suspension means 2 is then bent around in the direction of the housing 1 and through the second opening 15, which is also situated at the lower end of the housing between the yoke 13 and the yoke 17, and out of the housing again. Subsequently, the suspension means 2 and the loop 20 can be laid over the first wrap-round element 3. This is shown in FIG. 6. Two oppositely-running sections of the suspension means 2 thus lay themselves around the wrap-round element 3. The end of the loop 20 of the suspension means 2 then forms an eye 23. The bolt 4 or second wrap-round element can be inserted into the eye 23. Subsequently, the fixing element 5 shown in FIG. 4 is fastened onto the lower yoke 13, and its surface 51 engages in the groove 41 of the bolt 4. The suspension means 2 then needs to be brought into tension only by pulling on the length away from the end. The suspension means 2 can also be a flat belt, and the belt can also have a surface structure, as shown for example in FIGS. 1 and 2. Whether the surface structures of the suspension means 2 lie on top of each other, or the flat sides of a suspension belt lie on top of each other, is for the function of the suspension-means end-fastener 6 irrelevant. Even if its surfaces are differently formed, the suspension belt 2 can hence be inserted in both directions.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A suspension-means end-fastener for fastening a suspension means of an elevator system, comprising:

a housing having two spaced apart side walls;

at least first and second wrap-round elements configured to fasten the suspension means in said housing, wherein each of said first and second wrap-round elements extends between said two side walls, and said second wrap-round element is a movable bolt configured to be inserted into said housing at a predetermined position, wherein said second wrap-round element has at least one groove, and wherein said at least one groove is located between said side walls of said housing when said second wrap-round element is in the predetermined position; and a fixing element configured to be mounted on said housing for fixing said second wrap-round element in the predetermined position in said housing after said second wrap-round is inserted into said housing in the predetermined position, wherein said fixing element is configured to engage in said at least one groove of said second wrap-round element, wherein said fixing element has a surface that extends parallel to one of said side walls of said housing into said housing, wherein said surface has a recess which is complementary to a cross-sectional shape of said second wrap-round element, wherein said recess is dimensioned to accept said second wrap-round element only at said at least one groove, and wherein said surface of said fixing element that extends into said housing is dimensioned so that flanks of said recess extend beyond a mid-point of a cross section of said second wrap-round element and said recess is U-shaped for receiving said second wrap-round element when said fixing element is inserted into said housing after said second wrap-round element is inserted into said housing in the predetermined position.

2. The suspension-means end-fastener according to claim 1, wherein said fixing element is configured to be tightly fastened to a lower yoke of said housing.

3. The suspension-means end-fastener according to claim 1, wherein said flanks of said fixing element are arranged between a lower yoke of said housing and said second wrap-round element and are configured to fill a space between said lower yoke and said second wrap-round element.

4. The suspension-means end-fastener according to claim 1, wherein an end-piece of the suspension means is laid into a loop and arranged in said housing, whereby two oppositely-running sections of the loop wrap around said first wrap-round element, and said second wrap-round element is inserted through an eye of the loop.

5. A suspension-means end-fastener for fastening a suspension means of an elevator system, comprising:

a housing having two spaced apart side walls;

first and second wrap-round elements configured to fasten the suspension means in said housing, wherein each of said first and second wrap-round elements extends between said two side walls, and said second wrap-round element is removably inserted into said housing at a predetermined position, wherein said second wrap-round element has at least one groove, and wherein said at least one groove is located between said side walls of said housing when said second wrap-round element is in the predetermined position; and a fixing element releasably mounted on said housing and engaging said at least one groove of said second wrap-round element to removably fix said second wrap-round element in the predetermined position in said housing after said second wrap-round element is inserted into said housing in the predetermined position, wherein said fixing-element is dimensioned to engage said second wrap-round element only at said at least one groove, wherein said fixing-element has a U-shaped recess for receiving said second wrap-round element when said fixing element is inserted into said housing after said second wrap-round element is inserted into said housing in the predetermined position, whereby an end-piece of the suspension means is laid into a loop and arranged in said housing between said side walls with two oppositely-running sections of the loop wrapped around said first wrap-round element, and said second wrap-round element inserted through an eye of the loop.

6. The suspension-means end-fastener according to claim 5, wherein said fixing element is releasably fastened to a lower yoke of said housing.

7. The suspension-means end-fastener according to claim 5, wherein said fixing element has a surface that extends parallel to one of said side walls of said housing into said housing, wherein said surface has said recess which is complementary to a cross-sectional shape of said second wrap-round element, and wherein said recess is dimensioned to accept said second wrap-round element at said at least one groove.

8. The suspension-means end-fastener according to claim 7, wherein said surface of said fixing element that extends into said housing is dimensioned so that flanks of said recess extend beyond a mid-point of a cross section of said second wrap-round element.

9. The suspension-means end-fastener according to claim 8, wherein said flanks of said fixing element are arranged between a lower yoke of said housing and said second wrap-round element and are configured to fill a space between said lower yoke and said second wrap-round element.

10. The suspension-means end-fastener according to claim 5, wherein said fixing element is releasably fastened to a first yoke of said housing and said housing has a second yoke spaced from said first yoke, and wherein the end-piece of the suspension means enters said housing through an opening in said housing adjacent said second yoke and exits said housing through a gap between said first yoke and said second yoke.

11. A suspension-means end-fastener for fastening a suspension means of an elevator system, comprising:

a housing having two spaced apart side walls, each of said side walls having an opening formed therein;

a first wrap-around element configured to fasten the suspension means in said housing and extending between said side walls;

a second wrap-round element configured to fasten the suspension means in said housing, wherein said second wrap-round element is removably inserted into said housing through said openings at a predetermined position, said second wrap-round element having at least one groove, and wherein said at least one groove is located between said side walls of said housing when said second wrap-round element is in the predetermined position;

first and second yokes spaced apart by a gap and extending between said side walls; and a fixing element releasably mounted on said first yoke and engaging said at least one groove of said second wrap-round element to removably fix said second wrap-round element in the predetermined position in said housing after said second wrap-round element is inserted into said housing in the predetermined position, whereby when an end-piece of the suspension means is laid into a loop and is arranged in said housing between said side walls with two oppositely-running sections of the loop wrapped around said first wrap-round element, said second wrap-round element is inserted through an eye of the loop, the end-piece of the suspension means enters said housing through an opening in said housing adjacent said second yoke and exits said housing through said gap between said first yoke and said second yoke, wherein said fixing element has a surface that extends parallel to one of said side walls of said housing into said housing, wherein said surface has a recess which is complementary to a cross-sectional shape of said second wrap-round element, wherein said recess is dimensioned to only accept said second wrap-round element at said at least one groove, and wherein said surface of said fixing element that extends into said housing is dimensioned so that flanks of said recess extend beyond a mid-point of a cross section of said second wrap-round element and said recess is U-shaped for receiving said second wrap-round element when said fixing element is inserted into said housing after said second wrap-round element is inserted into said housing in the predetermined position.

* * * * *